US012781397B2

(12) United States Patent
Yeh et al.

(10) Patent No.: US 12,781,397 B2
(45) Date of Patent: Nov. 3, 2026

(54) HIGH-STRENGTH COMPOSITE YARN FABRIC

(71) Applicant: HONMYUE ENTERPRISE CO., LTD., Changhua County (TW)

(72) Inventors: Po-Yu Yeh, Changhua County (TW); Yen-Hung Kuo, Changhua County (TW); Hsien-Chun Huang, Changhua County (TW)

(73) Assignee: HONMYUE ENTERPRISE CO., LTD., Changhua County (TW)

( * ) Notice: Subject to any disclaimer, the term of this patent is extended or adjusted under 35 U.S.C. 154(b) by 203 days.

(21) Appl. No.: 18/621,814

(22) Filed: Mar. 29, 2024

(65) Prior Publication Data

US 2025/0207305 A1 Jun. 26, 2025

(30) Foreign Application Priority Data

Dec. 25, 2023 (TW) ..... 112150661

(51) Int. Cl.
*D03D 15/292* (2021.01)
*D03D 13/00* (2006.01)
*D03D 15/573* (2021.01)

(52) U.S. Cl.
CPC ..... *D03D 15/292* (2021.01); *D03D 13/00* (2013.01); *D03D 15/573* (2021.01); *D10B 2321/0211* (2013.01); *D10B 2331/04* (2013.01)

(58) Field of Classification Search
CPC .... D03D 13/00; D03D 15/292; D03D 15/573; D03D 1/0035; D03D 15/283; D03D 15/47; D03D 15/00; D10B 2321/0211; D10B 2331/04; D02G 3/36; D02G 3/442; D02G 3/04
See application file for complete search history.

(56) References Cited

U.S. PATENT DOCUMENTS

2014/0090349 A1* 4/2014 Fisher ..... D02G 3/38 57/227
2020/0407599 A1* 12/2020 Leermann ..... C09J 7/385

FOREIGN PATENT DOCUMENTS

CN 208586387 U 3/2019
CN 114150411 A 3/2022
CN 218580350 U 3/2023

OTHER PUBLICATIONS

Taiwanese Search Report for Taiwanese Application No. 112150661, dated Apr. 18, 2024, with an English translation.

* cited by examiner

*Primary Examiner* — Lynda Salvatore
(74) *Attorney, Agent, or Firm* — Birch, Stewart, Kolasch & Birch, LLP

(57) ABSTRACT

A high-strength composite yarn fabric includes a plurality of first composite yarns and a plurality of second composite yarns. The first composite yarns and the second composite yarns are interwoven. Each first composite yarn has a first core layer and a first wrapping layer. The first core layer is ultra-high molecular weight polyethylene. The first wrapping layer wraps around the first core layer. T second composite yarn has a second core layer and a second wrapping layer. The second core layer is polyester fiber. The second wrapping layer wraps around the second core layer. The high-strength composite yarn fabric is knitted with the first composite yarns and the second composite yarns made of specific materials to enhance the physical strength and the durability of the high-strength composite yarn fabric.

14 Claims, 2 Drawing Sheets

HIGH-STRENGTH COMPOSITE YARN FABRIC

BACKGROUND OF THE INVENTION

Technical Field

The present invention relates generally to a textile technology for composite yarns, and more particularly to a high-strength composite yarn fabric.

Description of Related Art

With the abnormal changes in global climate, the summer heat rises year by year, causing a lot of floods, hurricanes, wildfires, and other natural disasters around the world. In the case of hurricanes or typhoons, the strong wind pressure and the heavy rainfall do not only destroy windows, doors, or walls, but flying objects (sand and gravel) blown up by the strong winds also easily damage the windows and the doors. As a result, people inside the building are threatened by the strong winds.

In order to solve the problems caused by the hurricanes or the strong winds, reinforced door curtains are usually installed on an outside of the windows and the doors to cover an exterior of the windows or glass doors, thereby providing resistance to the wind pressure of the strong winds caused by the hurricanes or the typhoons and protecting the windows and the doors from damages caused by the flying objects. There are many kinds of existing reinforced door curtains. In recent years, a reinforced door curtain made of textile fabrics is developed for weight reduction and physical appearance. A textile material of the reinforced door curtain makes use of composite yarns for weaving, wherein wefts of the reinforced door curtain include aramid fibers (TWARON fibers) and a surface is covered by polyvinyl chloride (PVC), while warps include polyester fibers (PET) and a surface is covered by polyvinyl chloride (PVC). By the weaving combination of the composite yarns made of different materials, the reinforced door curtain has a specific physical strength. However, the combination of the textile material and composite yarns used in the reinforced door curtain does not provide excellent resistance and durability in the practical process of resisting the strong winds and cannot provide a long-term resistance to the strong winds or the flying objects.

BRIEF SUMMARY OF THE INVENTION

In view of the above, the primary objective of the present invention is to provide a high-strength composite yarn fabric, wherein the durability and the resistance against strong winds could be enhanced by weaving with particular composite yarns.

The present invention provides a high-strength composite yarn fabric, including a plurality of first composite yarns and a plurality of second composite yarns. The first composite yarns and the second composite yarns are interwoven. Each first composite yarn has a first core layer and a first wrapping layer; the first core layer is ultra-high molecular weight polyethylene. The first wrapping layer wraps around the first core layer. Each second composite yarn has a second core layer and a second wrapping layer. The second core layer is polyester fiber. The second wrapping layer wraps around the second core layer.

In an embodiment, both a denier of the first composite yarns and a denier of the second composite yarns are at least 5000 D; the denier of the second composite yarns is greater than the denier of the first composite yarns.

In an embodiment, a denier of the first core layer of each first composite yarn is at least 1000 D; a denier of the second core layer of each second composite yarn is at least 1000 D; the denier of the first core layer is greater than the denier of the second core layer.

In an embodiment, a linear density of the first composite yarns ranges between 10 threads/inch and 15 threads/inch; a linear density of the second composite yarns ranges between 20 threads/inch and 25 threads/inch.

In an embodiment, a content of the first core layer ranges between 5 wt % and 20 wt % of a total content of each first composite yarn; a content of the first wrapping layer ranges between 65 wt % and 75 wt % of the total content of each first composite yarn; an average molecular weight of the ultra-high molecular weight polyethylene of the first core layer ranges between 3500000 MN and 9000000 MN; a material of the first wrapping layer comprises polyethylene, polyvinyl chloride, polypropylene, or polystyrene.

In an embodiment, a content of the second core layer ranges between 10 wt % and 25 wt % of a total content of each second composite yarn; a content of the second wrapping layer ranges between 65 wt % and 75 wt % of the total content of each second composite yarn; a material of the second wrapping layer comprises polyethylene, polyvinyl chloride, polypropylene, or polystyrene.

In an embodiment, the first composite yarns are wefts; the second composite yarns are warps.

In an embodiment, a tearing strength of the first composite yarns is greater than a tearing strength of the second composite yarns; a tensile strength of the second composite yarns is greater than a tensile strength of the first composite yarns.

With the aforementioned design, the high-strength composite yarn fabric is knitted with the first composite yarns and the second composite yarns made of specific materials to enhance the tensile strength of the high-strength composite yarn fabric in both the warp direction and the weft direction, wherein the tearing strength of the first composite yarns in the weft direction is greater than the tearing strength of the second composite yarns in the warp direction, and the tensile strength of the second composite yarns is greater than the tensile strength of the first composite yarns. When the high-strength composite yarn fabric is used as an outdoor curtain or an outdoor blind, the physical properties of the high-strength composite yarn fabric could effectively prevent the outdoor curtain or the outdoor blind from being broken by flying objects in storms and could resist the strong wind pressure, thereby strengthening the high-strength composite yarn fabrics in resisting the strong winds.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
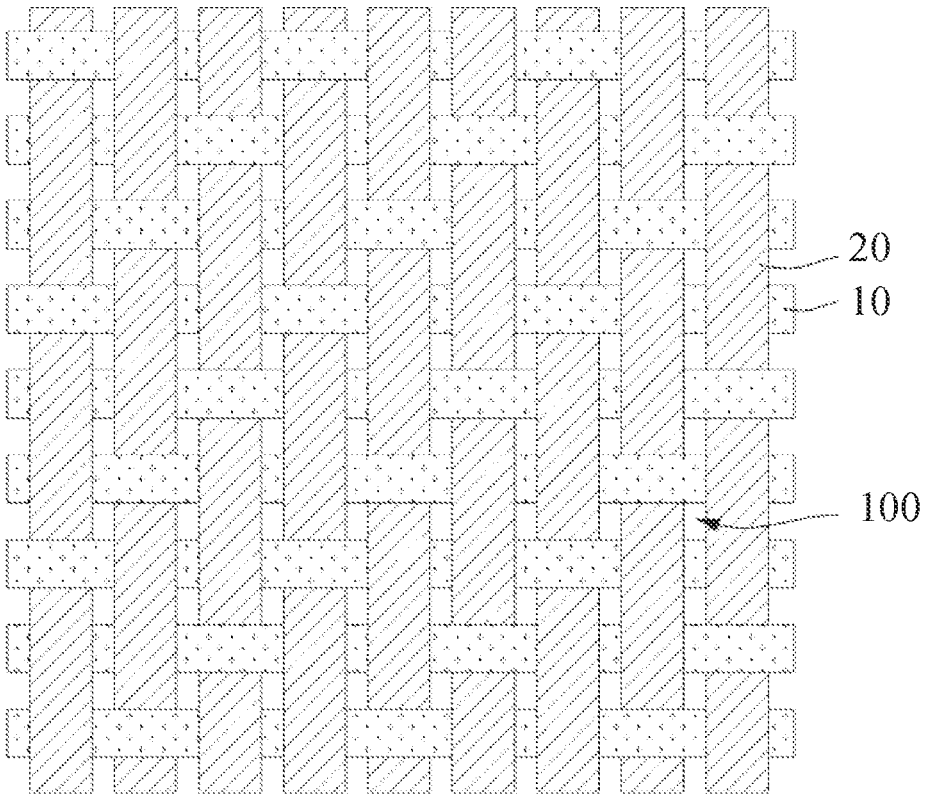
FIG. 1 is a schematic view of the high-strength composite yarn fabric according to an embodiment of the present invention.
Figure 2:
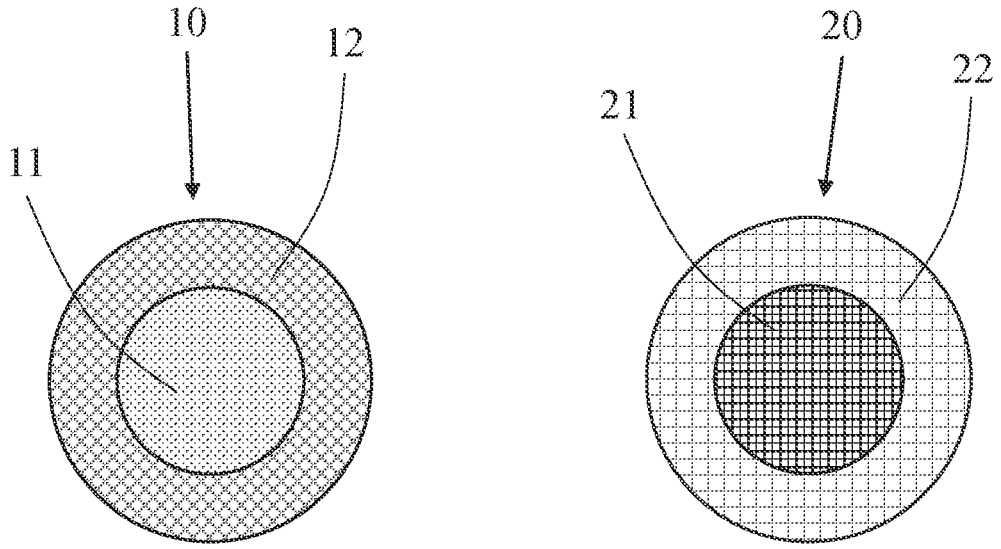
FIG. 2 is a sectional schematic view of the first composite yarn and the second composite yarn of the high-strength composite yarn fabric according to the embodiment of the present invention.

A high-strength composite yarn fabric 100 according to an embodiment of the present invention is illustrated in FIG. 1 and FIG. 2 and includes a plurality of first composite yarns 10 and a plurality of second composite yarns 20. The first composite yarns 10 and the second composite yarns 20 are interwoven. In the current embodiment, the first composite yarns 10 are wefts, and the second composite yarns 20 are warps, but not limited thereto. In other embodiments, the first composite yarns 10 could be warps, the second composite yarns 20 could be wefts.

"Yarn" in the current embodiment is a continuous bundle formed or composed of multiple fibers or filaments, and a cross section of each first composite yarn 10 and a cross section of each second composite yarn 20 shown in FIG. 2 are exemplified by a circular shape. However, the cross section of each first composite yarn 10 and the cross section of each second composite yarn 20 could also be in other shapes that are regular or irregular, such as a flat shape or an elliptical shape.

Each first composite yarn 10 has a first core layer 11 and a first wrapping layer 12. Each first core layer 11 is ultra-high molecular weight polyethylene (UPE), wherein an average molecular weight of the ultra-high molecular weight polyethylene (UPE) ranges between 3500000 MN and 9000000 MN. Referring to FIG. 2, in the cross section of each first composite yarn 10, each first wrapping layer 12 wraps around each first core layer 11, wherein each first wrapping layer 12 concentrically wraps around an axis of each first core layer 11. A material of each first wrapping layer 12 includes polyethylene (PE), polyvinyl chloride (PVC), polypropylene (PP), or polystyrene (PS). A content of each first core layer 11 ranges between 5 wt % and 20 wt % of a total content of each first composite yarn 10. A content of each first wrapping layer 12 ranges between 65 wt % and 75 wt % of the total content of each first composite yarn 10. A denier of the first core layer 11 of each first composite yarn 10 is at least 1000 D. In an embodiment, the denier of each first core layer 11 ranges between 1000 D and 2000 D. In another embodiment, the denier of each first core layer 11 ranges between 1200 D and 1600 D.

Each second composite yarn 20 has a second core layer 21 and a second wrapping layer 22. Each second core layer 21 is polyester fiber (PET). In the cross section of each second composite yarn 20, each second wrapping layer 22 wraps around each second core layer 21, wherein each second wrapping layer 22 concentrically wraps around an axis of each second core layer 21. A material of each second wrapping layer 22 includes polyethylene (PE), polyvinyl chloride (PVC), polypropylene (PP), or polystyrene (PS). A content of each second core layer 21 ranges between 10 wt % and 25 wt % of a total content of each second composite yarn 20. A content of each second wrapping layer 22 ranges between 65 wt % and 75 wt % of the total content of each second composite yarn 20. A denier of the second core layer 21 of each second composite yarn 20 is at least 1000 D. In an embodiment, the denier of each second core layer 21 ranges between 1000 D and 2000 D. In another embodiment, the denier of each second core layer 21 ranges between 1200 D and 1500 D, and the denier of each first core layer 11 is greater than the denier of each second core layer 21.

Moreover, both a denier of the first composite yarns 10 and a denier of the second composite yarns 20 of the high-strength composite yarn fabric 100 are at least 5000 D, wherein the denier of the first composite yarns 10 and the denier of the second composite yarns 20 respectively range between 5000 D and 6000 D, and the denier of the second composite yarns 20 is greater than the denier of the first composite yarns 10. In addition, a linear density of the first composite yarns 10 ranges between 10 threads/inch and 15 threads/inch, and a linear density of the second composite yarns 20 ranges between 20 threads/inch and 25 threads/inch. In the high-strength composite yarn fabric 100, the linear density of the second composite yarns 20 that are in a warp direction is greater than the linear density of the first composite yarns 10 that are in a weft direction.

Therefore, the high-strength composite yarn fabric 100 is knitted with the first composite yarns 10 and the second composite yarns 20 that are made of the specific materials, so that tensile strengths of the high-strength composite yarn fabric 100 in the warp direction and in the weft direction is enhanced. A tearing strength of the first composite yarns 10 in the weft direction is greater than a tearing strength of the second composite yarns 20 in the warp direction, and a tensile strength of the second composite yarns 20 is higher than a tensile strength of the first composite yarns 10, thereby enhancing the durability of the high-strength composite yarn fabric 100 in resisting strong winds.

Further, in order to thoroughly illustrate the primary objective, features, and functions of the present invention, the current embodiment provides a property test of the high-strength composite yarn fabric 100, wherein the test provides an experimental group and a control group to explore differences in physical strengths.

Textile Materials and Content:

The experimental group: the high-strength composite yarn fabric 100 includes the first composite yarns 10 (wefts) and the second composite yarns 20 (warps). The content of each first core layers 11 ranges between 10 wt % and 15 wt % of the total content of each first composite yarn 10. The content of each first wrapping layer 12 ranges between 68 wt % and 73 wt % of the total content of each first composite yarn 10. The denier of each first core layer 11 is about 1600 D. The content of each second core layer 21 ranges between 15 wt % and 20 wt % of the total content of each second composite yarn 20. The content of each second wrapping layer 22 ranges between 68 wt % and 73 wt % of the total content of each second composite yarn 20. The denier of each second core layer 21 is about 1500 D. Both the material of each wrapping layer 12 and the material of each second wrapping layer 22 are polyvinyl chloride (PVC). In the high-strength composite yarn fabric 100, the denier of the first composite yarns 10 is 5300 D, and the denier of the second composite yarns 20 is 5400 D.

The control group: wefts and warps of a fabric are respectively composite yarns. Each weft includes a core layer and a wrapping layer. A material of the core layer of each weft is aramid fiber (TWARON fiber). A content of the core layer of each weft ranges between 10 wt % and 15 wt % of a total content of each weft. A content of the wrapping layer of each weft ranges between 68 wt % and 73 wt % of the total content of each weft. A denier of the core layer of each weft is about 2000 D. Each warp includes a core layer and a wrapping layer. A material of the core layer of each warp is polyester fiber (PET). A content of the core layer of each warp ranges between 15 wt % and 20 wt % of a total content of each warp. A content of the wrapping layer of each warp ranges between 68 wt % and 73 wt % of the total content of each warp. A denier of the core layer of each warp is about 1500 D. Both the wrapping layer of each weft and the wrapping layer of each warp are polyvinyl chloride (PVC). In the control group, a denier of the wefts of the fabric is about 5400 D, and a denier of the warps of the fabric is about 5400 D.

Textile compositions and contents of the experimental group and the control group are shown in Table 1 below.

TABLE 1 the textile compositions and content ratios of the experimental group and the control group

| Textile compositions and content | | Experimental group | | Control group | |
|---|---|---|---|---|---|
| | | Weft | Warp | Weft | Warp |
| Core layer | Material and content | Ultra-high molecular weight polyethylene (UPE) (10 wt %~15 wt %) | Polyester fiber (PET) (15 wt %~20 wt %) | Aramid fiber (Twaron fiber) (10 wt %~15 wt %) | Polyester fiber (PET) (15 wt %~20 wt %) |
| | Denier | 1600D | 1500D | 2000D | 1500D |
| Wrapping layer | | Polyvinyl chloride (PVC) (68 wt %~73 wt %) | | Polyvinyl chloride (PVC) (68 wt %~73 wt %) | |
| | Denier | 5300D | 5400D | 5400D | 5400D |

Physical Strength Test and Results:

The experimental group and the control group are subjected to physical property tests including tensile strength, tearing strength, elongation rate, etc., of the fabric in a warp direction and in a weft direction, respectively, and bursting strength and impact resistance of the experimental group and the control group are tested at the same time. The tensile strength is tested according to ASTM D5034 Standard. The tearing strength is tested according to ASTM D2261 Standard. The elongation rate is tested according to ASTM D5034 Standard. The bursting strength is tested according to ASTM D3786 Standard. The impact resistance is tested according to ASTM E1886/1996 Standard. ASTM E1886/1996 Standard is a standard test method for performance of exterior windows, curtain walls, doors, and impact protective systems impacted by missile(s) and exposed to cyclic pressure differentials. The results of the physical property tests are shown in Table 2 below.

TABLE 2 the results of the physical strength tests of the experimental group and the control group

| Physical property tests | | Experimental group | Control group |
|---|---|---|---|
| Tensile strength (lbf) | Warp direction | 1024 | 671 |
| | Weft direction | 1013 | 821 |
| Tearing strength (lbf) | Warp direction | 218 | 142 |
| | Weft direction | 424 | 113 (slip) |
| Elongation rate (%) | Warp direction | 18 | 10 |
| | Weft direction | 14 | 68 (slip) |
| Bursting strength (PSI) | | 1010 | 1250 |
| Impact resistance | | — | pass |

'slip' indicates that the test machine does not have enough grip and the fabric is too strong.

As can be seen from Table 2 above, in the tensile strength test results, the experimental group has a tensile strength of 1024 lbf in the warp direction and a tensile strength of 1013 lbf in the weft direction. The control group has a tensile strength of 671 lbf in the warp direction and a tensile strength of 821 lbf in the weft direction. Apparently, the tensile strengths of the experimental group in the warp direction and in the weft direction are superior to the tensile strengths of the control group in the warp direction and in the weft direction. The tensile strengths of the experimental group in the warp direction and in the weft direction are both at least greater than 1000 lbf.

In addition, in the tearing strength test results, the experimental group has a tearing strength of 218 lbf in the warp direction and a tearing strength of 424 lbf in the weft direction. The control group has a tearing strength of 142 lbf in the warp direction and a tearing strength of 1131 lbf in the weft direction, but slipping of the machine occurs in the tearing strength test in the weft direction for the control group. Therefore, the tearing strengths of the experimental group in the warp direction and in the weft direction are better than the tearing strengths of the control group in the warp direction and in the weft direction. In the elongation rate test results, the experimental group has an elongation rate of 18% in the warp direction and an elongation rate of 14% in the weft direction. The control group has an elongation rate of 10% in the warp direction and an elongation rate of 68% in the weft direction, but slipping of the machine occurs in the elongation rate test in the weft direction for the control group.

Moreover, in the bursting strength test results, the experimental group has a bursting strength of 1010 PSI and the control group has a bursting strength of 1250 PSI, which indicates that the bursting strength of the control group is greater than the bursting strength of the experimental group. In the impact resistance test results, the fabric of the control group produces a penetration phenomenon relative to the experimental group, which indicates that the experimental group has an excellent performance of impact resistance.

Summarizing the above physical property tests, the first core layers 11 of the first composite yarns 10 in the high-strength composite yarn fabric 100 of the experimental group specifically make use of ultra-high molecular weight polyethylene (UPE) and the first composite yarns 10 are knitted with the second composite yarns 20, so that the physical properties of the experimental group are significantly better than the physical properties of the control group in the tests of the tensile strength, the tearing strength, and the elongation rate, and the experimental group has a better impact resistance performance. Therefore, the first composite yarns 10 and the second composite yarns 20, which are made of specific materials, in the high-strength composite yarn fabric 100 are knitted, so that the physical strength of the high-strength composite yarn fabric 100 in the warp direction and in the weft direction could be effectively enhanced. When the high-strength composite yarn fabric 100 is used as an outdoor curtain or an outdoor blind, the physical properties of the high-strength composite yarn fabric 100 could effectively prevent the outdoor curtain or the outdoor blind from being broken by flying objects in storms and could resist the wind pressure of strong winds and hurricanes, thereby enhancing the durability and the resistance against the strong winds.

It must be pointed out that the embodiments described above are only some preferred embodiments of the present invention. All equivalent structures which employ the concepts disclosed in this specification and the appended claims should fall within the scope of the present invention.

What is claimed is:

1. A high-strength composite yarn fabric, comprising:

a plurality of first composite yarns, wherein each of the plurality of first composite yarns has a first core layer and a first wrapping layer; the first core layer is ultra-high molecular weight polyethylene; the first wrapping layer wraps around the first core layer; and a plurality of second composite yarns, wherein the plurality of second composite yarns and the plurality of first composite yarns are interwoven; each of the plurality of second composite yarns has a second core layer and a second wrapping layer; the second core layer is polyester fiber; the second wrapping layer wraps around the second core layer;

wherein a denier of the plurality of first composite yarns and a denier of the plurality of second composite yarns respectively range between 5000 D and 6000 D; the denier of the plurality of second composite yarns is greater than the denier of the plurality of first composite yarns, and wherein the plurality of first composite yarns are wefts, and the plurality of second composite yarns are warps.

2. The high-strength composite yarn fabric as claimed in claim 1, wherein a denier of the first core layer of each of the plurality of first composite yarns is at least 1000 D; a denier of the second core layer of each of the plurality of second composite yarns is at least 1000 D; the denier of the first core layer is greater than the denier of the second core layer.

3. The high-strength composite yarn fabric as claimed in claim 1, wherein a linear density of the plurality of first composite yarns ranges between 10 threads/inch and 15 threads/inch; a linear density of the plurality of second composite yarns ranges between 20 threads/inch and 25 threads/inch.

4. The high-strength composite yarn fabric as claimed in claim 1, wherein a content of the first core layer ranges between 5 wt % and 20 wt % of a total content of each of the plurality of first composite yarns; a content of the first wrapping layer ranges between 65 wt % and 75 wt % of the total content of each of the plurality of first composite yarns.

5. The high-strength composite yarn fabric as claimed in claim 4, wherein an average molecular weight of the ultra-high molecular weight polyethylene of the first core layer ranges between 3500000 MN and 9000000 MN; a material of the first wrapping layer comprises polyethylene, polyvinyl chloride, polypropylene, or polystyrene.

6. The high-strength composite yarn fabric as claimed in claim 1, wherein a content of the second core layer ranges between 10 wt % and 25 wt % of a total content of each of the plurality of second composite yarns; a content of the second wrapping layer ranges between 65 wt % and 75 wt % of the total content of each of the plurality of second composite yarns.

7. The high-strength composite yarn fabric as claimed in claim 6, wherein a material of the second wrapping layer comprises polyethylene, polyvinyl chloride, polypropylene, or polystyrene.

8. The high-strength composite yarn fabric as claimed in claim 1, wherein a tearing strength of the plurality of first composite yarns is greater than a tearing strength of the plurality of second composite yarns; a tensile strength of the plurality of second composite yarns is greater than a tensile strength of the plurality of first composite yarns.

9. The high-strength composite yarn fabric as claimed in claim 2, wherein a tearing strength of the plurality of first composite yarns is greater than a tearing strength of the plurality of second composite yarns; a tensile strength of the plurality of second composite yarns is greater than a tensile strength of the plurality of first composite yarns.

10. The high-strength composite yarn fabric as claimed in claim 3, wherein a tearing strength of the plurality of first composite yarns is greater than a tearing strength of the plurality of second composite yarns; a tensile strength of the plurality of second composite yarns is greater than a tensile strength of the plurality of first composite yarns.

11. The high-strength composite yarn fabric as claimed in claim 4, wherein a tearing strength of the plurality of first composite yarns is greater than a tearing strength of the plurality of second composite yarns; a tensile strength of the plurality of second composite yarns is greater than a tensile strength of the plurality of first composite yarns.

12. The high-strength composite yarn fabric as claimed in claim 5, wherein a tearing strength of the plurality of first composite yarns is greater than a tearing strength of the plurality of second composite yarns; a tensile strength of the plurality of second composite yarns is greater than a tensile strength of the plurality of first composite yarns.

13. The high-strength composite yarn fabric as claimed in claim 6, wherein a tearing strength of the plurality of first composite yarns is greater than a tearing strength of the plurality of second composite yarns; a tensile strength of the plurality of second composite yarns is greater than a tensile strength of the plurality of first composite yarns.

14. The high-strength composite yarn fabric as claimed in claim 7, wherein a tearing strength of the plurality of first composite yarns is greater than a tearing strength of the plurality of second composite yarns; a tensile strength of the plurality of second composite yarns is greater than a tensile strength of the plurality of first composite yarns.

* * * * *